US007557731B2

(12) United States Patent
Ramasubbu

(10) Patent No.: US 7,557,731 B2
(45) Date of Patent: Jul. 7, 2009

(54) RFID READER ENABLED INTELLIGENT TRAFFIC SIGNALLING AND RFID ENABLED VEHICLE TAGS (NUMBER PLATES)

(76) Inventor: Sridhara Subbiah Ramasubbu, 6512 Limerick Ct., Clarksville, MD (US) 21029

( * ) Notice: Subject to any disclaimer, the term of this patent is extended or adjusted under 35 U.S.C. 154(b) by 304 days.

(21) Appl. No.: 11/558,178

(22) Filed: Nov. 9, 2006

(65) Prior Publication Data

US 2008/0150759 A1 Jun. 26, 2008

(51) Int. Cl.
*G08G 1/08* (2006.01)

(52) U.S. Cl. ..... 340/922; 340/572.4; 340/917; 340/941

(58) Field of Classification Search ..... 340/916, 340/917, 922, 933, 941, 572.1, 572.4, 572.8
See application file for complete search history.

(56) References Cited

U.S. PATENT DOCUMENTS

| | | | | |
|---|---|---|---|---|
| 5,917,432 | A * | 6/1999 | Rathbone | 340/917 |
| 2004/0189493 | A1 * | 9/2004 | Estus et al. | 340/988 |
| 2005/0278082 | A1 * | 12/2005 | Weekes | 340/438 |
| 2006/0017587 | A1 * | 1/2006 | Park et al. | 340/988 |
| 2006/0202862 | A1 * | 9/2006 | Ratnakar | 340/933 |

* cited by examiner

*Primary Examiner*—Thomas J Mullen

(57) ABSTRACT

A system and method for regulating the flow of traffic at a roadway intersection having one or more traffic signals by positioning a processor in the vicinity of the intersection to store cycle times of the traffic flow directions, mounting an RFID reader in the vicinity of each traffic signal in communication with the processor, mounting a plurality of RFID tags in the vicinity of a license plate so as to be within the communication range of an RFID reader at the intersection and so that the RFID readers interrogate the RFID tags of the vehicles, calculating an unused time slice of the cycle time for at least one of the traffic flow directions at the intersection; and, reducing the cycle time for the traffic flow.

8 Claims, 2 Drawing Sheets

RFID READER ENABLED INTELLIGENT TRAFFIC SIGNALLING AND RFID ENABLED VEHICLE TAGS (NUMBER PLATES)

BACKGROUND OF THE INVENTION

1. Field of the Invention

The invention relates to traffic control systems and, more particularly, to an Intelligent system that switches a traffic signal utilizing an unused time slice. This is achieved by installing smart RFID readers along with the intelligent processor which read the license plates of the vehicles stopped in the signal to calculate the signaling time more efficiently.

2. Description of Related Art

Automobiles are a part of everyday life in urban and suburban communities. Traffic lights dot the landscape in urban centers and the surrounding communities, and control the flow of traffic on roads, large and small. Drivers must pay attention to traffic signals, and failure to heed them, results in increased traffic congestion and accidents.

While traffic controls are a necessary part of any road and highway system, measures are taken to try to keep the traffic flow on the major arteries moving as much as possible.

SUMMARY OF THE INVENTION

In accordance with the present invention, Radio Frequency ID readers installed in the traffic signal read the license plates of the vehicles stopped at the signal and are processed by the Intelligent processor to switch the signals more efficiently and effectively.

The Priority Index and other information assigned to each RFID tag fitted to the license plate by a motor vehicle administration or department of motor vehicles can be used to override the signal or to track the vehicles without GPS or cell phone.

Tracking the vehicles in the absence of GPS and cell phones—Nobody can drive vehicles without license plates.

Deadly traffic violations like "Running Red Light" can be controlled by recording the violated vehicles and can be ticketed.

RFID readers fitted to law enforcement vehicles can easily get the information about the vehicles in trouble even in the absence of wireless connection and satellite communication.

This can be achieved by utilizing the unused time slice. The "Unused" time slice happens when there are very few vehicles given larger time slice to pass by. At this moment, this unused time slice can be awarded to most demanding direction based on this invention. This invention always ensures the safety of vehicles by giving enough time for the oncoming vehicles to stop at the time of switching.

The priority index is the code or numbering assigned to each RFID tag fitted to the license plate by the motor vehicle administration or department of motor vehicles which can be read by the RFID reader installed in the traffic signal to judge the importance of the vehicles waiting for the signals.

Any additional information stored in the RFID tags fitted to the license plates by MVA or DMV can also be used to track the vehicle movement without GPS or cell phone tracking system.

This invention is completely different from the conventional traffic signal and any other traffic related smart systems in the following ways:

This is different from the conventional traffic signal, which checks the lane only at the time of switching, not after the switching.

It is also different, that the unused time is allocated to the most wanted direction, not to the next signal in sequence.

The RFID readers are installed in every direction of the traffic signal.

The intelligent processor is installed locally to the traffic signal and can also interact with the other traffic signal processors.

Priority of the license plates fitted to the vehicles can be analyzed by these local processors to give right of way to emergency vehicles like ambulance and law enforcement vehicles.

The vehicles will not receive any data from the intelligent processor.

The traffic signal cannot be influenced by any other source except the count and the priority index of the vehicles.

The data processed by the processor will not be broadcasted to any external systems.

DESCRIPTION OF THE INVENTION

Process

Scenario Without the Invention

A traffic signal at an intersection in one direction allocates 30 seconds for a vehicle (e.g., T1 in FIG. 1) to make a left turn.

25 seconds remain unused after that vehicle (e.g., T1 in FIG. 1) passes.

Traffic signals for the crosswise direction switch to green to let the vehicles to pass.

Process: Scenario with the Invention

Figure 1:
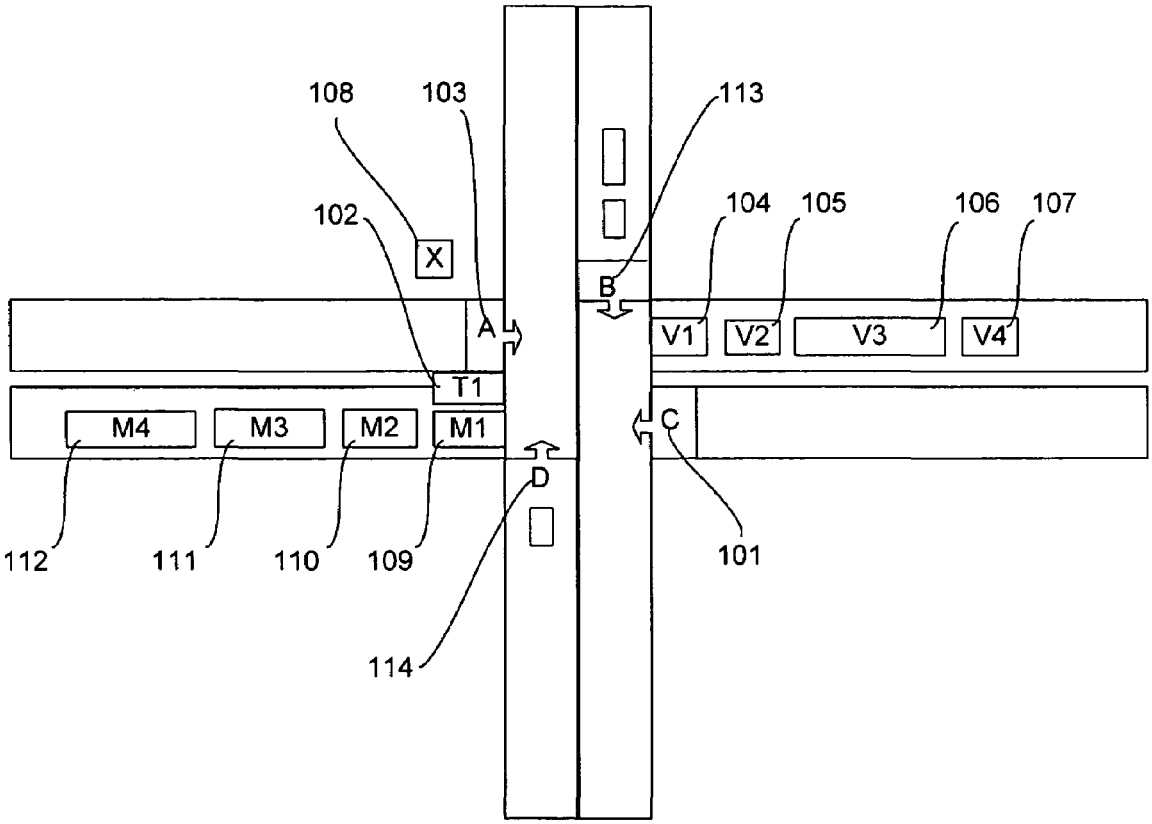
FIG. 1 illustrates the general architecture of the present invention.

In FIG. 1: A (103), B (113), C (101), and D (114) are signal RFID readers; X (108) is Intelligent Processor; V1 (104), V2 (105), V3 (106), and V4 (107) are vehicles traveling west; and T1 is a vehicle traveling east, turning left at the signal.

Signal containing RFID reader C (101) allocates 30 seconds for the vehicle T1 (102) to take left.

Signal containing RFID reader C (101) finds no vehicles in the middle lane.

Signal containing RFID reader A (103), which is in next sequence, reads and calculates the vehicles V1 (104), V2 (105), V3 (106) and V4 (107).

The Intelligent Processor X (108) is provided with the information from signal RFID readers C (101) and A (103).

The Processor X (108) decides to utilize the unused 25 seconds, and switch the signals containing RFID readers A (103) and C (101) to "green" to let vehicles V1 (104), V2 (105), V3 (106) and V4 (107) and M1 (109), M2 (110), M3 (111), and M4 (112) to pass, since the traffic is more in that direction.

Signals containing RFID readers B (113) and D (114) are activated in their regular allocated time.

This extra switching will reduce the traffic congestion in that signal.

This is different from the conventional traffic signal, which checks the middle lane only at the time of switching, not after the switching.

It is also different in that the unused time is allocated to the most wanted direction, not to the next signal in sequence.

Figure 2:
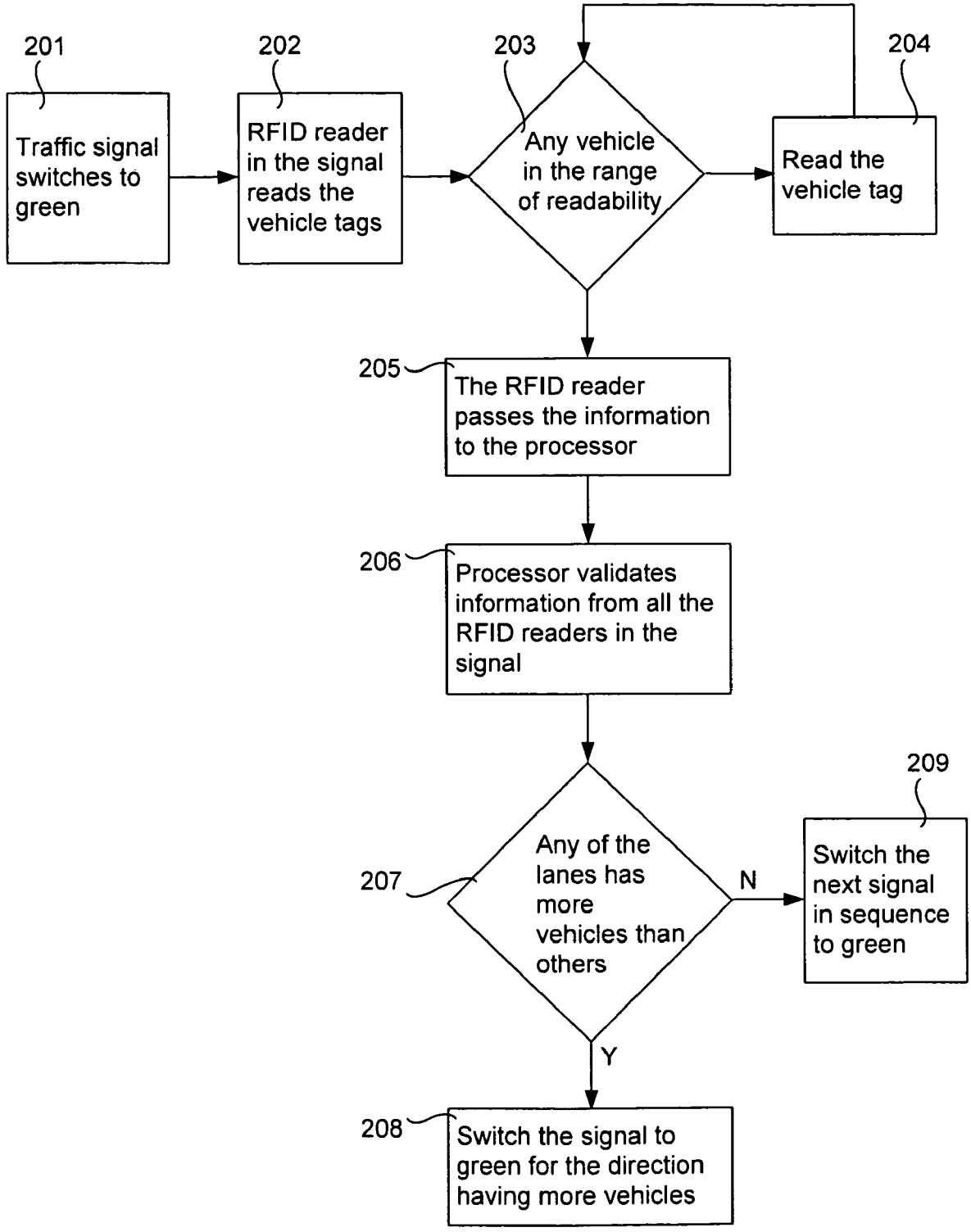
FIG. 2 is a flowchart illustrating the steps in the method of the switching system.

FIG. 2 illustrates a method of the invention, for example, a traffic signal switches to green (201); the RFID reader in the signal reads the vehicle tags (202); when a vehicle is in the range of readability (203), the signal reads the vehicle tag (204); the RFID reader passes the information to the processor (205); the processor validates information from all the RFID readers in the signal (206); when any of the lanes has more vehicles than others (207), switch the signal to green for the direction having more vehicles (208); or switch the next signal in sequence to green (209).

I claim:

1. A method for regulating the flow of traffic at a roadway intersection having one or more traffic signals, comprising:

positioning a processor in the vicinity of the intersection, said processor storing adaptable cycle times for each traffic signal at the intersection corresponding to all of the traffic flow directions at the intersection which are controlled by the one or more traffic signals;

mounting an RFID reader having a predetermined communication range in the vicinity of each traffic signal at the intersection, each RFID reader in communication with the processor at that intersection, each traffic signal corresponding to one or more of said traffic flow directions;

mounting a plurality of RFID tags in the vicinity of a license plate of each of a corresponding plurality of vehicles;

wherein, when one or more vehicles having corresponding license plate-mounted RFID tags approach the intersection so as to be within the communication range of an RFID reader, the RFID readers interrogate the RFID tags of the vehicles to count the number of RFID-tagged vehicles present in all of the traffic flow directions at the intersection;

in response to counting the number of RFID-tagged vehicles present in all of the traffic flow directions at the intersection, calculating an unused time slice of the cycle time for at least one of the traffic flow directions at the intersection; and, reducing the cycle time for said at least one of the traffic flow directions in accordance with the unused time slice, and increasing the cycle time for at least one other of said one or more of the traffic flow directions in accordance with the unused time slice.

2. A method as recited in claim 1, wherein the processor receives priority data from RFID tags mounted to police and emergency vehicles, for which right of way through the intersection is to be granted during emergency situations, and processes said data to control the traffic signals in order to grant said right of way.

3. A method as recited in claim 1, wherein increasing the cycle time for another of said one or more of the traffic flow directions in accordance with the unused time slice is based on a calculated demand for the unused time slice.

4. A method as recited in claim 3, wherein the processor allocates the unused time slice to the traffic flow direction determined to have the greatest demand.

5. A method as recited in claim 1, wherein the processor is capable of sending data to, and receiving data from, other processors carrying out the same functions in the vicinity of other intersections.

6. A method as recited in claim 1, wherein an RFID reader may additionally be mounted in a police vehicle, for receiving data from an RFID tag on a particular other vehicle.

7. A method as recited in claim 1, wherein the cycle times include the duration of each of the green, yellow and red lights during a given cycle; and, the unused time slice corresponds to at least a portion of the green light duration in a given traffic flow direction.

8. A system for regulating the flow of traffic at a roadway intersection having one or more traffic signals, comprising:

a processor positioned in the vicinity of the intersection, said processor storing adaptable cycle times for each traffic signal at the intersection corresponding to all of the traffic flow directions at the intersection which are controlled by the one or more traffic signals;

an RFID reader having a predetermined communication range and located in the vicinity of each traffic signal at the intersection, each RFID reader in communication with the processor at that intersection, each traffic signal corresponding to one or more of said traffic flow directions;

a plurality of RFID tags mounted in the vicinity of a license plate of each of a corresponding plurality of vehicles;

wherein, when one or more vehicles having corresponding license plate-mounted RFID tags approach the intersection so as to be within the communication range of an RFID reader, the RFID readers interrogate the RFID tags of the vehicles to count the number of RFID-tagged vehicles present in all of the traffic flow directions at the intersection;

wherein the processor, in response to counting the number of RFID-tagged vehicles present in all of the traffic flow directions at the intersection, calculates an unused time slice of the cycle time for at least one of the traffic flow directions at the intersection; and, wherein the processor reduces the cycle time for said at least one of the traffic flow directions in accordance with the unused time slice, and increases the cycle time for at least one other of said one or more of the traffic flow directions in accordance with the unused time slice.

* * * * *